US006090254A

United States Patent [19]

Sobata et al.

[11] Patent Number: 6,090,254

[45] **Date of Patent: *Jul. 18, 2000**

[54] PROCESS FOR COATING METALLIC MOLDING ARTICLES

[75] Inventors: Tamotsu Sobata, Ibaraki; Naohiko Sumie, Kobe, both of Japan

[73] Assignee: Nippon Paint Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/828,197

[22] Filed: Mar. 21, 1997

[30] Foreign Application Priority Data

Mar. 21, 1996 [JP] Japan ..... 8-093277

[51] Int. Cl.[7] ..... C25D 5/34; C25D 13/20; B05D 1/18

[52] U.S. Cl. ..... 204/510; 204/471; 205/210; 205/217; 205/219; 427/327; 427/430.1; 427/443.2

[58] Field of Search ..... 427/299, 430.1, 427/435, 436, 443.2, 327; 205/210, 211, 219, 217; 204/471, 510

[56] References Cited

U.S. PATENT DOCUMENTS

| | | | |
|---|---|---|---|
| 4,101,386 | 7/1978 | Dotzer et al. | 204/32 R |
| 4,132,568 | 1/1979 | Irwin | 134/3 |
| 4,194,922 | 3/1980 | Gransell et al. | 134/1 |
| 4,419,199 | 12/1983 | Hauffe et al. | 204/181 R |
| 4,504,324 | 3/1985 | Furuno | 148/6.15 R |
| 4,824,538 | 4/1989 | Hibino et al. | 204/180.2 |
| 4,911,818 | 3/1990 | Kikuchi et al. | 204/300 EC |
| 4,954,180 | 9/1990 | Malloy | 134/22.13 |
| 5,013,411 | 5/1991 | Minowa et al. | 204/29 |
| 5,100,516 | 3/1992 | Nishimura et al. | 205/145 |
| 5,380,451 | 1/1995 | Rieger | 252/79.2 |
| 5,780,122 | 7/1998 | Shirahata et al. | 427/601 |

*Primary Examiner*—Diana Dudash
*Assistant Examiner*—Michael Barr
*Attorney, Agent, or Firm*—Pollock, Vande Sande & Amernick

[57] ABSTRACT

A process for coating a metallic molding article comprising transporting said article by conveyer means continuously and serially through a degreasing stage (1), a first water rinsing stage (2), a surface conditioning stage (3), a chemical conversion treatment stage (4), a second water rinsing stage (5), and an electrodeposition coating stage (6), wherein at least one stage of said stage (1), (2), (3), (4), (5) comprises in dipping said article in a treating bath of dipping system, at least one unit of said treating bath is provided with a vibratory agitation means, and the angles of immersion and emergence of said article with respect to said bath are not less than 25 degrees. The invention contributes to a curtailment of pre-treatment before coating and an effective elimination of adherent metal particles from the matallic article to provide a very satisfactory coating film.

2 Claims, 3 Drawing Sheets

PROCESS FOR COATING METALLIC MOLDING ARTICLES

FIELD OF THE INVENTION

The present invention relates to a process for coating metallic molding articles such as automotive bodies in which each molding article is subjected to a continuous series of pre-treatments and electrodeposition coating on an industrial scale while it is transported by a conveyer line.

BACKGROUND TECHNOLOGY

For the manufacture of metallic molding products such as automotive bodies and household electrical appliances, metallic materials such as steel sheets, galvanized steel sheets, etc. are formd to metallic molding articles, coated, and assembled. Coating of such metallic molding parts is generally carried out by a serial process which comprises degreasing, surface conditioning, chemical treatment, electrodeposition coating, etc.

The coating of a metallic molding products (hereinafter referred to briefly as a metallic article or, more briefly, an article) is carried out in a serial line comprising a degreasing stage for degreasing the surface of the article, a surface conditioning stage in which the degreasing agent is eliminated from the article surface, a chemical conversion treatment stage, and an electrodeposition coating stage.

This each process of the coating process generally comprises a combination of dipping, circulating spray, and mist spray systems. The dipping system consists in dipping the article in a treating agent in a dip bath. The dipping system is particularly advantageous for the treatment of an article having an internal "pocket" structure because metal particles deposited in the pocket portion can he effectively eliminated. However, when the article is large, the equipment has to be proportionally large-sized so that not only the initial cost is high but the amount of treating agents are large, thus increasing the burden on work for effluent disposal.

The circulating spray system is a system for cleaning an article by ejecting a large amount of treating solution against the article at the rate of, for example, not less than 3 L, usually about 5 L, per 1 $m^2$ of the article. This circulating spray system reuses the recycled treating solution and, therefore is advantageous over the dipping system in that, inter alia, the amount of the treating solution and that of the effluent can both be reduced. Although this system insures a sufficient cleaning of the article surface, it has the disadvantage that the internal pocket portion of the article cannot be thoroughly treated.

The mist spray system is a system which comprises ejecting a treating solution against the article at the rate of, for example, not more than 3 L, usually about 2 L, per 1 $m^2$ of the article. This mist spray system is advantageous in that the required amount of treating solution and the amount of effluent are comparatively small and the size of equipment required is smaller. However, just like the above-mentioned circulating spray system, this system cannot effectively treat the internal pocket structure, although it treats the surface well.

As shown in FIG. 4, the conventional process for coating a metallic molding article utilizing a combination of the above-mentioned systems comprises a step of rinsing the article with warm water using a warm water rinse sprayer 51 and/or a warm water rinse dip bath 52, a degreasing step using a degreasing sprayer 53 and/or a degreasing dip bath 54, and a rinsing step using a water rinse sprayer 55 and/or a water rinse dip bath 56. The article is thence dipped in a surface conditioning bath 57 and a chemical conversion treatment bath 58 in series. The thus-treated article is rinsed with a water rinse sprayer 59 and/or a water rinse dip bath 60, further rinsed with a pure water rinse sprayer 61, and finally electrocoated by dipping in an electrodeposition coating bath 62.

In the above series, the rate of elimination of metal particles is about 35% at the warm water rinse stage, about 65 cumulative % until the degreasing stage, and about 90 cumulative % until the rinse stage just before the electrodeposition coating bath 62. Thus, about 90% of the metal particles are eliminated uutil the electrodeposition coating bath 62 and the remainder or about 10% is carried over into the electrodeposition coating bath 62. The metal particles carried over to the electrodeposition coating stage are comparatively large, sized 80 to 200 $\mu$m in diameter, and smaller particles sized less than 80 $\mu$m, have been eliminated from the article surface by the treatments such as dipping treatments preceding the electrodeposition coating bath 62.

However, since comparatively large particles sized 80 to 200 $\mu$m in diameter are not completely eliminated by the above-mentioned dipping treatments, they remain in the interior of the article and when the article is dipped in the electrodeposition coating bath 62, the solution in which has a relatively high specific gravity, they are dislodged from the article, float on the bath, and are deposited on the surface of the electrostatic coating film to cause film spots. Therefore, in order that the incidence of spot in electrodeposition coating may be precluded, it is necessary to remove metal particles of comparatively large size, namely 80 to 200 $\mu$m in diameter, in the course up to the electrodeposition coating bath 62.

Japanese Kokai Publication Hei-6-23332 discloses an apparatus adapted to wash the surface-treated metallic article with a non-pressurized water surge shower and, in addition, bubble air through the cleaning bath solution.

Japanese Kokai Publication Hei-5-339766 discloses a cleaning equipment in which a bubbling device is used to generate microfine air bubbles in the cleaning bath. Japanese Kokai Publication Hei-5-110232 discloses a cleaning method which comprises cleaning a metallic article with air bubbles in the cleaning solution. Japanese Kokai Publication Hei-6-179987 discloses an aeration equipment in which an excess of oxygen is introduced into the cleaning water to clean the surface of a metallic article with microfine gas-phase oxygen.

However, by any of these technologies involving the use of air bubbles formed in the cleaning bath to clean a metallic article, it is difficult to dislodge sufficiently the metal particles deposited in the inner cavity or pocket of the metallic article.

Japanese Kokoku Publication Hei-6-71544 discloses a system for surface treatment and cleaning of a metallic article by means of an ultravibrator.

However, since this technology consists in the mere use of an ultravibrator, neither the surface treatment system nor the cleaning system is sufficiently effective in removing the metal particles deposited in the interior of the metallic article. Moreover, metal particles cannot be removed from the interior of the article at its emergence from the cleaning bath. Thus, metal particles remaining in the interior of the article, particularly particles from 80 to 200 $\mu$m in diameter, float up on entry into the electrodeposition coating bath to become copresipitated on the electrodeposition film surface, thus giving rise to film spots.

Aside from the above technologies, a method of controlling the angles of immersion and emergence of the article with respect to a treating bath, such as a cleaning bath, has been proposed. However, with this angle control procedure alone, the metal particles once dislodged from the interior of the article upon immersion are deposited on the interior of the article, so that the particles are hardly removed at emergence of the article from the bath. Therefore, the metal particles floating up upon immersion of the article into the electrodeposition coating bath become coprecipitated on the electrodeposition film.

OBJECT AND SUMMARY OF THE INVENTION

In the above state of the art, the present invention has for its object to provide a process for coating a metallic molding article by electrodeposition coating by which metal particles deposited on the surface, in the interior, or in pockets of the metallic article can be effectively dislodged and eliminated in the pre-treatment stage to provide an electrodeposition film with a good appearance and the pre-coating treatment can be curtailed.

Designed to solve the above problems, a process for coating a metallic molding article of the present invention comprises transporting said article by conveyer means continuously and serially through a degreasing stage (1) adapted to degrease the article surface, a first water rising stage (2), a surface conditioning stage (3), a chemical conversion treatment stage (4), a second water rinsing stage (5), and an electrodeposition coating stage (6), at least one stage of the group consisting of said degreasing stage (1), first water rinsing stage (2), surface conditioning stage (3), chemical conversion treatment stage (4), and second water rinsing stage (5) comprising dipping said article in a treating bath of dipping system and at least one unit of said treating bath being provided with a viblatory agitation means, and the angles of immersion and emergence of the article with respect to said bath being not less than 25°.

BRIEF DESCRIPTION OF THE DRAWINGS

The present invention is now described with reference to the preferred embodiment illustrated on the accompanying drawings, in which.

DETAILED DESCRIPTION OF THE INVENTION

Figure 1:
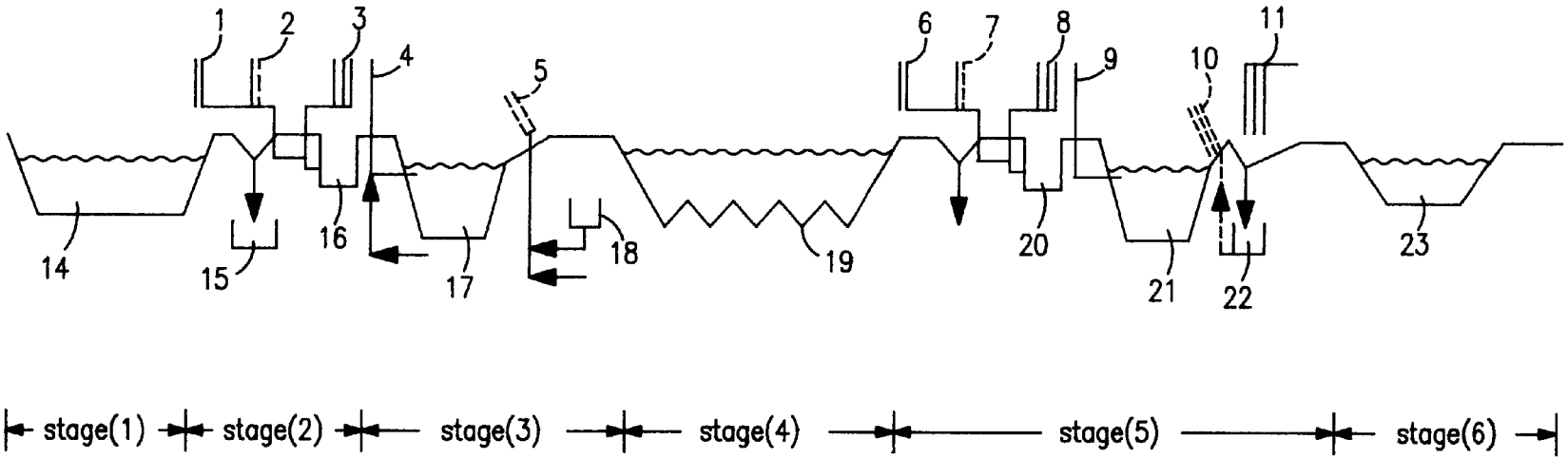
FIG. 1 is an elementary diagram illustrating the process of the present invention for coating metallic molding articles.

As mentioned above, at least one of said degreasing stage (1), first water rinsing stage (2), surface conditioning stage (3), chemical conversion treatment stage (4), and second water rinsing stage (5) comprises dipping the metallic article in a treating bath of dipping system. Even if only one of said stages (1) to (5) is above mentioned dipping stage, the metal particles adherent to the surface, interior, or pocket of the metallic article can be effectively removed. For a more effective removal of metal particles, it is preferable that two or more of said stages, for example said degreasing stage (1) and chemical conversion treatment stage (4); or said degreasing stage (1), surface conditioning stage (3), and chemical conversion treatment stage (4), should each comprise dipping the article in a treating bath of dipping system. It is still more preferable to arrange so that all of said stages (1) through (5) respectively comprise dipping the article.

At least one of said treating baths is provided with a vibratory agitation means. As this vibratory agitation means comprises an ultravibratory agitator can be used. By using such an ultravibratory agitator, the metal particles adherent to the article can be efficiently dislodged. Moreover, the dislodged particles are not allowed to settle in the interior of the article but caused to float, so that they are not redeposited on the metallic article.

The ultravibratory agitator may be any device comprising a vibration motor as a source of vibration, a vibration plate submerged in the bath, and a vibration transmission means which transmit the vibrations generated by said vibration motor to the submerged vibration plate, with a dynamic association of the three parts, and is not critical in kind. Thus, a variety of commercial ultravibratory cleaning devices can be selectively employed.

In the present invention, the treating bath of dipping system is not particularly restricted in type and typically a boat-shaped treating bath can be utilized. The dipping process is now described in detail, taking such a boat-shaped treating bath as an example.

The angle of immersion and that of emergence of the article with respect to the bath in the boat-shaped treating bath equipped with said vibratory agitation means are not less than 25°. In the conventional pre-coating dipping bath, the angles of immersion and emergence of the article are 20 to 22° and the overall length of the bath is longer and, hence, the equipment required for pre-coating treatments is of large scale. In the boat-shaped treating bath used in the present invention, the angles of immersion and emergence of the article are not less than 25° and, therefore, the overall length of the baths is shorter and the pre-coating process can be curtained.

Furthermore, in the conventional boat-shaped treating bath, even if it is equipped with a vibration means for eliminating metal particles, its angles of immersion and emergence, which are 20–22°, present the problem that when the article is an automotive body, for instance, the metal particles dislodged by the vibratory agitator are those of comparatively small size, i.e. less than 80 $\mu$m in diameter, and larger particles in excess of 80 $\mu$m remain in the nooks and recesses of the automotive body. In the boat-shaped treating bath used in the present invention, which is equipped with the vibratory agitation means and has immersion and emergence angles of not less than 25° the dynamic pressure of the treating solution acting on the interior of the automotive body, especially on the floor surface, is so high that dislodging effect of metal particles sized 80–200 $\mu$m, which cause film spots, increases, and the metal particles are more effectively dislodged and the dislodged particles are not allowed to resettle but float, thus enabling the dislodged metal particles to be removed outside from the automotive body at emergence from the bath, without remaining inside. Therefore, not only comparatively small metal particles of less than 80 $\mu$m but also large particles ranging from 80 to 200 $\mu$m in diameter are not carried over to the electrodeposition coating stage so that coprecipitation of metal particles on electrodeposition film can be prevented.

Since the dislodged metal particles float in said boat-shaped treating bath, they can be easily removed from the bath by a suitable means such as a filter.

The electrodeposition coating stage (6) comprises dipping the article in a treating bath of dipping system, typically in a boat-shaped treating bath. This boat-shaped treating bath is preferably such that angle of immersion of the article is less than 25°.

When the immersion angle of the boat-shaped treating bath used in said electrodeposition coating stage (6) is less than 25°, the metallic article can be gently immersed in the boat-shaped treating bath. Therefore, even if comparatively large metal particles over 200 $\mu$m in diameter remain in the interior of the article, the particles will not float upon dipping so that no film spots will be formed in the electrodeposition film.

In the present invention wherein said pre-treatment stages (1) to (5) and said electrodeposition coating stage (6) are used in combination, all metal particles liable to float upon dipping of the article in the electrodeposition coating dip bath to cause film spots are effectively dislodged and eliminated and even if large metal particles over 200 $\mu$m in diameter happen to remain in the interior of the article, they are not allowed to float up, with the result that the coprecipitation of metal particles in electrodeposition is successfully prevented. As a consequence, the problem of film spot inevitable with the conventional coating technology is eliminated.

There is no particular limitation on the metallic molding article that can be treated and coated by the process of the invention. Thus, for example, automotive bodies and household electrical appliances which are fabricated of metallic material such as steel sheet, galvanized steel sheet, etc. can be mentioned.

The coating process of the present invention being as described above, it contributes to a curtailment of pre-treatment before coating and an effective elimination of adherent metal particles from the matallic article to provide a very satisfactory coating film.

PREFERRED EMBODIMENTS OF THE INVENTION

The present invention is now described in detail with reference to the accompanying drawings.

FIG. 1 is an elementary diagram illustrating a typical process for coating a metallic molding article in accordance with the present invention.

In the illustrated coating process, a metallic molding article, such as an automotive body, is transported by a conveyer line continuously and serially through a degreasing stage (1), a first water rinsing stage (2), a surface conditioning stage (3), a chemical conversion treatment stage (4), a second water rinsing stage (5), and an electrodeposition coating stage (6).

In the above degreasing stage (1), the article is dipped in a degreasing solution in a boat-shaped degreasing bath 14. The composition of the degreasing solution is not particularly restricted in kind, and may for example be an alkaline degreasing solution or a non-phosphorus, non-nitrogen degreasing solution.

The first water rinsing stage (2) comprises a couple of mist sprayers 1, 2 and a circulating sprayer 3. Although the first water rinsing stage (2) illustrated in FIG. 1 is not provided with dipping system, a water rinsing stage having dipping system can be utilized in the practice of the present invention.

The mist sprayer 1 mentioned above is disposed overhead the exit region of the degreasing bath 14. The treating solution (pre-treatment solution) for use by the mist sprayer 1 is the solution (post-treatment solution) recycled from the circulating sprayer 3 via a recovery tank 16 and the solution ejected from the mist sprayer 1 is recovered into the degreasing bath 14.

As used throughout this specification, the term "pre-treatment solution" means the treating solution prior to use in each stage and the term "post-treatment solution" means the treating solution after use in each stage.

Since the post-treatment solution from the above mist sprayer 1 is entirely recovered in the degreasing stage (1), the total amount of effluent from the system is as much decreased.

The amount of the pre-treatment solution used by said mist sprayer 1 is very small as compared with the amount of the pre-treatment solution used by said mist sprayer 2. There is no particular restriction on the ratio of the amount of the pre-treatment solution used by said mist sprayer 1 to the amount of the pre-treatment solution used by said mist sprayer 2, for instance, but based on 1 L/m$^2$ of the pre-treatment solution to be used by said mist sprayer 2, the amount of the pre-treatment solution for use by said mist sprayer 1 is preferably in the range of 0.01 to 0.05 L/m$^2$. The mist sprayer 1 may for example be a dual-fluid spray nozzle using air and the pre-treatment solution, such as a coating gun.

In the above-mentioned mist sprayer 2, the post-treatment solution recycled from said circulating sprayer 3 via the recovery tank 16 is used as the pre-treatment solution and the post-treatment solution from this mist sprayer 2 is discharged from the system. A sufficient treating effect can be obtained when the amount of the pre-treatment solution ejected from this mist sprayer 2 is 1 L/m$^2$.

In the present invention, the surface of the metallic article can be effectively treated because of this multi-stage mist spray system which comprises said mist sprayer 1, which substitutes the article surface with a small amount of treating solution to minimize the amount of the degreasing solution carried over to the surface conditioning stage (3), and said mist sprayer 2, which compresses a small amount of treating solution with pump and ejects it to obtain treatment effect thereof.

The above-mentioned circulating sprayer 3 uses the treating solution pooled in the recovery tank 16 as the pre-treatment solution by circulation thereof, arid the post-treatment solution from this sprayer 3 is recovered in said recovery tank 16. A sufficient treating effect is obtained when the amount of the pre-treatment solution ejected by the circulating sprayer 3 is 4 L/m$^2$.

Since the multi-stage mist spray system is disposed as a stage proceeding said circulating sprayer 3 in the present invention, it is sufficient to use only one unit of circulating sprayer 3. Therefore, compared with the conventional coating line requiring a plurality of large-scale circulating sprayers, the pre-coating process is drastically curtailed.

The above-mentioned surface conditioning stage (3) comprises a mist sprayer 4, a surface conditioning bath 17, a mist sprayer 5, and a conditioner tank 18.

The mist sprayer 4 uses a mixture of the post-treatment solution from the surface conditioning bath 17 and clean water as the pre-treatment solution and the post-treatment solution from this sprayer 4 is recovered in the recovery tank 16. A sufficient treating effect is obtained when the amount of the pre-treatment solution ejected from the mist sprayer 4 is 0.5 L/m$^2$.

The term "clean water" as used throughout this specification means water which does not contain contaminators, such as metal ions, which is not preferable for the metallic article in the coating process, and for exaple, deionized water which can be prepared by subjecting tap water to ion-exchange treatment can be used.

The mist sprayer 4 substitutes the article surface with only a small amount of treating solution so that the amount of the degreasing solution carried over to the surface conditioning bath 17 is decreased.

The treatment carried out in said surface conditioning bath 17 is a full-dip treatment which comprises submerging the article in a surface conditioning bath. Therefore, even the pocket portions of the article are effectively treated.

Since said first water rinsing stage (2) and mist sprayer 4 are disposed before said surface conditioning bath 17 in the present invention, the metallic article surface can be thoroughly treated without the need to provide a plurality of immersion steps. Therefore, compared with the conventional coating line involving a plurality of large-sized dip baths, the pre-coating process can be drastically curtailed and the pre-coating treatment time is also decreased.

Since the treatment in said surface conditioning bath 17 entails the carry-over of only a small amount of degreasing solution into the surface conditioning bath 17 because of the upstream multi-stage rinsing system, the functional degradation of the surface conditioning solution in the bath 17 is suppressed. Therefore, the pocket portions of the article are very effectively treated as compared with the surface conditioning process in the conventional coating line.

The above-mentioned mist sprayer 5 uses a fresh treating solution prepared from clean water and a surface conditioning agent as the pre-treatment solution. This fresh treating solution is supplied from a conditioner tank 18 to the mist sprayer 5. A sufficient treating effect is obtained when the amount of said fresh treating solution is 0.5 $L/m^2$.

Since the mist sprayer 5 is disposed overhead the exist region of the surface conditioning bath 17, the post-treatment solution from the sprayer 5 is entirely recovered in the conditioning bath 17. There is no particular restriction on the kind of surface conditioning agent that can be used but in order to insure a greater resistance to contaminator by degresing solution and improve the effect of chemical conversion treatment in the chemical conversion treatment stage (4) on the surface, particularly on the pocket portions, of the article, it is preferable to use a highly durable (substantially aging-free) surface conditioning agent.

The treatment by said mist sprayer 5 is the final mist spray treatment of the article using said fresh solution just before the chemical conversion treatment stage (4) and is effective in preventing dehydration of the article surface. For the prevention of dehydration of a metallic molding article in the conventional coating line, a spray treatment by a circulating sprayer has been employed. In the present invention, the entire article surface is covered with said fresh treating solution ejected by the mist sprayer, with the result that the effects of treatments obtained in the preceding series of steps are effectively retained till just before the chemical conversion treatment stage (4). The chemical conversion treatment stage (4) comprises dipping the article in a chemical conversion treatment solution in a boat-shaped chemical conversion treatment bath 19. Since this treatment is a full-dip process, not only the surface but also the interior and pocket portions of the article are effectively treated. There is no particular limitation on the kind of chemical conversion treatment solution that can be used but includes a zinc phosphate solution, for instance.

The second water rinsing stage (5) comprises mist sprayers 6, 7, a circulating sprayer 8, a mist sprayer 9, a water rinse dip bath 21, a mist sprayer 10, and a water rinse mist sprayer it.

The mist sprayer 6 is disposed overhead the exit region of the chemical conversion treatment bath 19. The pre-treatment solution for use by this mist sprayer 6 is the post-treatment solution from said circulating sprayer 8 via a recovery tank 20 and the post-treatment solution from the mist sprayer 6 is discharged into the chemical conversion treatment bath 19.

As mentioned above, the post-treatment solution from said mist sprayer 6 is entirely recovered in the chemical conversion treatment stage (4), with the result that the amount of effluent from the system can be decreased.

The amount of the pre-treatment solution used by said mist sprayer 6 is very small as compared with the amount of the pre-treatment solution used by said mist sprayer 7. There is no particular restriction on the ratio of the amount of pre-treatment solution for said mist sprayer 6 to the amount of pre-treatment solution for said mist sprayer 7, but based on 2 $L/m^2$ of the pre-treatment solution for said mist sprayer 7, the preferred amount of pre-treatment solution for said mist sprayer 6 is 0.01 $L/m^2$.

The pre-treatment solution used by said mist sprayer 7 is the post-treatment solution from said circulating sprayer 8 via a recovery tank 20 and a pump and the post-treatment solution from this mist sprayer 7 is discharged as an effluent from the system. A sufficient treating effect is obtained when the amount of the pre-treatment solution ejected from the mist sprayer 7 is 2 $L/m^2$.

The circulating sprayer 8 reuses the solution pooled in the recovery tank 20 as the pre-treatment solution and discharges the post-treatment solution into said recovery tank 20. A sufficient treating effect is obtained when the amount of the pre-treatment solution ejected from said circulating sprayer 8 is 2 $L/m^2$.

Since, in the present invention, the multi-stage mist spray system comprising said mist sprayers 6 and 7 is disposed before said circulating sprayer 8, it is sufficient to employ only one unit of circulating sprayer 8. Therefore, compared with the conventional coating line requiring a plurality of large-scale circulating sprayers, the pre-coating process can be drastically curtailed.

The pre-treatment solution used by said mist sprayer 9 is the post-treatment solution supplied from said water rinse dip bath by a pump and the post-treatment solution from this sprayer 9 is recovered in the recovery tank 20. A sufficient treating effect is obtained when the amount of the pre-treatment solution ejected by the mist sprayer 9 is 2 $L/m^2$.

In the present invention, the treatment by said mist sprayer 6 substitutes the article surface with water using a small amount of treating solution to reduce the amount of carry-over of the chemical conversion treatment solution. The treatment with a pressurized mist of water by said mist sprayer 7 achieves an effective cleaning of the metallic article surface. Furthermore, the treatment by said circulating sprayer 8 and mist sprayer 9 resubstitutes the metallic article surface with water to reduce the amount of carry-over of the chemical conversion treatment solution into said water rinse dip bath 21. Therefore, the metallic article surface is effectively treated and, at the same time, the amount of carry-over of the chemical conversion treatment solution is reduced.

For the treatment in said water rinse dip bath 21, the post-treatment solution from the mist sprayer 10 is used as the pre-treatment solution.

The treatment in said water rinse dip bath 21 is a full-dip process so that the interior and pocket portions of the metallic article are also effectively treated.

The above-mentioned mist sprayer 10 uses the post-treatment solrinse recycled from said mist sprayer 11 via a recovery tank 22 and a pump as the pre-treatment solution. Since the mist sprayer 10 is disposed overhead the exit region of said water rinse dip bath 21, the post-treatment solution from this sprayer 10 is entirely fed to said water rinse dip bath 21. A sufficient treating effect is obtained when the amount of the pre-treatment solution ejected from said mist sprayer 10 is 2 $L/m^2$.

The mist sprayer 11 uses clean water as the pre-treatment solution. A sufficient treating effect is obtained when the amount of this pre-treatment solution is 2 $L/m^2$.

In accordance with the present invention, the treatment by said mist sprayer 10 substitutes the metallic article surface with water and the treatment by said mist sprayer 11 substitutes the metallic article surface with clean water. Therefore, the article surface can be effectively rinsed by the multi-stage mist spray system comprising said mist sprayers 10 and 11.

In the above-mentioned second water rinsing stage (5), the clean water is used as the pre-treatment solution of the mist sprayer 11 and the post-treatment solution thereof is recovered in the recovery tank 22. The solution in the recovery tank 22 is used as the pre-treatment solution of the mist sprayer 10 and the post-treatment solution thereof is entirely pooled to the water rinse dip bath 21. The pre-treatment solution of the mist sprayer 9 is supplied from the water rinse dip bath 21 and the post-treatment solution thereof is recovered in the recovery tank 20. Moreover, the pre-treatment solutions of the mist sprayer 6, 7, and the circulating sprayer 8 are supplied from the recovery tank 20.

From the above explanation, it is apparent that, in said stage (5), the amount of water can be decreased because the post-treatment solution of each sprayer except for the mist sprayer 7 in the stage (5) is repeatedly used. Moreover, the total amount of effluent from the system can be decreased because the post-treatment solution of the mist sprayer 6 is entirely discharged into the chemical conversion treatment bath 19. The amount of pretreatment solution used in the mist sprayer 6 is very small. Therefore, the stage (5) can work only by introducing the clean water the amount of which is almost equal to that of effluent from the system by the mist sprayer 7.

Referring to the electrodeposition coating stage (6), an electrodeposition coating bath 23 is disposed so as to present an immersion angle of 20°. Therefore, the article is brough into sufficient contact with an electrodeposition solution so that an good surface appearance is obtained. There is no particular restriction on the composition of the electrodeposition solution only if it is suited for the electrodeposition coating of metallic articles.

The coating process for a metallic article in accordance with the present invention can be carried out using a preliminary degreasing stage before said degreasing stage (1) and the above-mentioned stages (1) through (6). This preliminary degreasing stage is preferably a warm-water rinsing stage.

Figure 2:
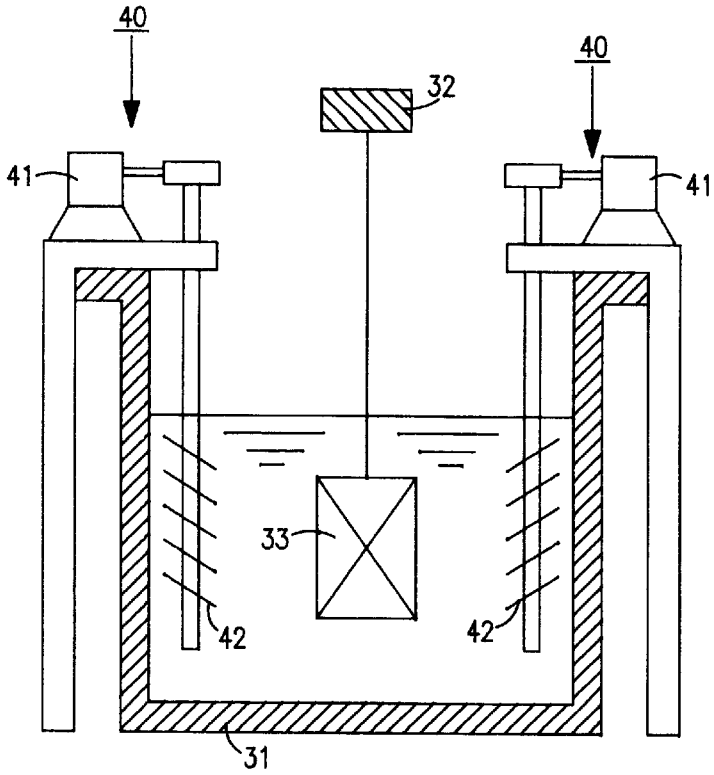
FIG. 2 is a transverse sectional view of a boat-shaped treating bath equipped with a vibratory agitation means for use in said process.

FIG. 2 is a transverse sectional view showing a boat-shaped treating bath equipped with a vibratory agitation means among the boat-shaped treating baths used in the degreasing stage (1), first water rinsing stage (2), surface conditioning stage (3), chemical conversion treatment stage (4), and second water rinsing stage (5).

In the present invention, at least one of the boat-shaped treating baths 31 used in the degreasing stage (1), first water rinsing stage (2), surface conditioning stage (3), chemical conversion treatment stage (4), and second water rinsing stage (5) is equipped with an ultravibratory agitator 40. This ultravibratory agitator 40 is an operatively integrated system comprising a vibrating motor 41 functioning as a source of vibration, submerged vibration plates 42, and a vibration transmission means adapted to transmit the vibrations generated by said vibrating motor 41 to the submerged vibration plates 42.

Figure 3:
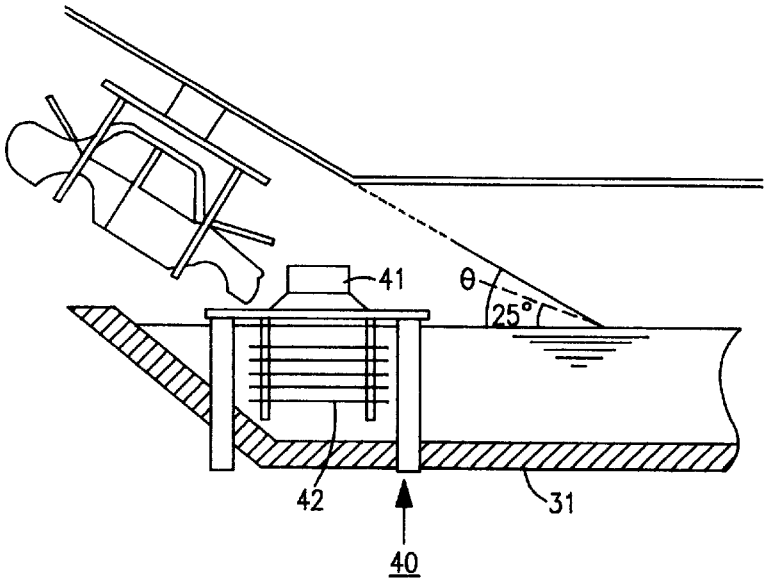
FIG. 3 is a longitudinal sectional view showing the same boat-shaped treating bath.
Figure 4:
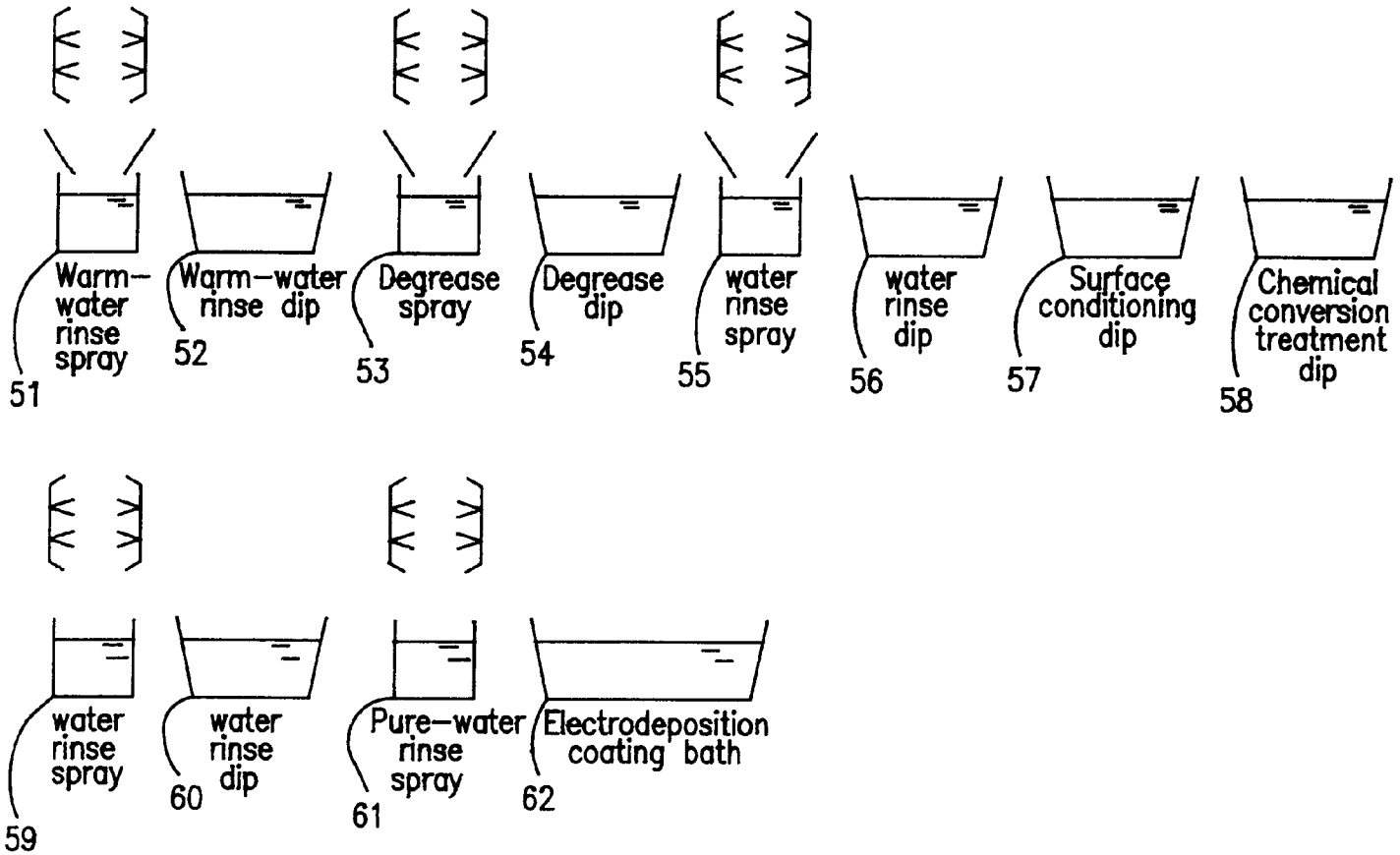
FIG. 4 is a schematic view of the conventional process for coating metallic molding articles.

In the present invention, the immersion and emergence angles θ into the boat-shaped treating bath 31 equipped with said vibratory agitation unit 40 are not less than 25° as illustrated in FIG. 3. Therefore, metal particles sized not greater than 200 μm in diameter as attached to the metallic article 33 are dislodged upon immersion of the article 33 into the bath and the metal particles dislodged by said ultravibratory agitator 40 are caused to float without resettling and removed from the metallic article 33 at its emergence from the bath. Moreover, compared with the conventional pre-coating equipment with immersion and emergence angles of 20–22°, the pre-coating process can be curtained.

The metallic article coating process employing the above-mentioned boat-shaped dip bath 31 can be carried to completion in an overall line length of about 104 m.

The following examples-are intended to describe the present invention in further detail and should by no means be construed as defining the scope of the invention.

EXAMPLE 1

Using a boat-shaped dip bath disposed at an immersion and emergence angles of 30° and equipped with an ultravibratory agitator in each of the degreasing stage and the chemical conversion treatment stage and setting the angle of immersion of the article in the boat-shaped dip bath of the electrodeposition stage at 20°, automotive bodies were coated and the metal particle eliminating performance and the appearance of the electrodeposition film were evaluated. The results are presented in Table 1.

Metal Particle Eliminating Performance

The metal particle elimination performance was evaluated for metal particles smaller than 80 μm and metal particles from 80 to 200 μm, respectively. The evaluation criteria were as follows.

◎: No residue of relevant metal particles in/on the article.

○: Little residue of relevant metal particles in/on the article.

Δ: A residue of relevant metal particles in/on the article.

X: A marked residue of relevant metal particles in/on the article.

Appearance of electrcoating Film

The electrocoaqting film formed was visually evaluated for film spots. The following evaluation criteria were used.

○: Only a maximum of 10 film spots associated with metal particles on the hood surface.

X: More than 10 spots associated with metal particles on the hood surface.

X X: More than 50 spots associated with metal particles on the hood surface.

Comparative Example 1

Setting the angles of immersion and emergense at 20 degrees for both boat-shaped dip baths in the degreasing stage and chemical conversion treatment stage and equipping with the conventional stirrer in lieu of the ultravibraory agitation means, automotive bodies were coated in otherwise the same manner as Example 1. Then, the metal particle eliminating performance and the appearance of the electrocoating film obtained were evaluated as in Example 1. The results are presented in Table 1.

Comparative Example 2

Automotive bodies were coated by the same procedure as that described in Example 1 except that the boat-shaped dip baths of the degreasing and chemical conversion treatment stages were respectively provided with the conventional stirrer in lieu of the ultravibratory agitator. The metal particle eliminating performance and the appearance of the electrodeposition film obtained were then evaluated. The results are presented in Table 1.

Comparative Example 3

Automotive bodies were coated in the same manner as Example 1 except that the boat-shaped dip baths of the degreasing and chemical conversion treatment stages were respectively provided with the conventional stirrer in lieu of the ultravibratory agitator and that the angle of immersion into the electrodeposition coating bath was set at 30°. The metal particle eliminating performance and the appearance of the electrocoating film obtained were then evaluated as in Example 1. The results are presented in Table 1.

Comparative Example 4

Automotive bodies were coated by the same procedure as that used in Example 1 except that the angles of immersion and emergence into the boat-shaped dip bath at the degreasing and chemical conversion treatment stages was set at 20°. The metal particle eliminating performance and the appearance of the electrodeposition film obtained were then evaluated as in Example 1. The results are presented in Table 1.

TABLE 1

| | Treatment Process before Coating | | | | Electrodeposition | | Metal Particle Eliminating Performance | | Appearance |
|---|---|---|---|---|---|---|---|---|---|
| | Angles of Immersion and Emergence | | Agitation in the Bath | | Coating Process Angle of Immersion | | in Treatment Process before Coating | | of Electrocoating |
| | not less than 25° | less than 25° | Vibratory Agitation | Conventional Agitation | less than 25° | not less than 25° | less than 80 μm | 80 to 200 μm | Film (Spot) |
| Example 1 | ○ | | ○ | | ○ | | ◎ | ○ | ○ |
| Comparative Example 1 | | ○ | | ○ | ○ | | Δ | x | x |
| Comparative Example 2 | ○ | | | ○ | ○ | | ○ | x | x |
| Comparative Example 3 | ○ | | | ○ | | ○ | ○ | x | xx |
| Comparative Example 4 | | ○ | ○ | | ○ | | ○ | x | x |

What is claimed is:

1. A process for coating a metallic molded automotive body which comprises transporting said automotive body by conveyor means continuously and serially through a degreasing stage (1) adapted to degrease the surface of the automotive body, a first water rinsing stage (2), a surface conditioning stage (3), a chemical conversion treatment stage (4), a second water rinsing stage (5), and an electrodeposition coating stage (6), wherein at least one stage of the group consisting of said degreasing stage (1), first water rinsing stage (2), surface conditioning stage (3), chemical conversion treatment stage (4), and second water rinsing stage (5) comprises in dipping said automotive body in a boat-shaped treating bath of dipping system, at least one unit of said treating bath is provided with vibratory agitation wherein said vibratory agitation is provided by employing a vibration motor as a source of vibration, a vibration plate submerged in said bath and vibration transmission means for transmitting vibrations generated by said vibration motor to said vibration plate and the angles of immersion and emergence of said automotive body with respect to said bath are not less than 25 degrees so that the dynamic pressure of the treating solution acting on the interior of the automotive body is high enough to dislodge metal particles sized 80–200 μm.

2. The process for coating a metallic molded automotive body according to claim 1 wherein said electrodeposition coating stage (6) comprises dipping said article in a treating bath of dipping system, and the angle of immersion of said automotive body with respect to said bath is less than 25 degrees.

* * * * *